United States Patent [19]

Ito et al.

[11] Patent Number: 4,741,066

[45] Date of Patent: May 3, 1988

[54] BRUSH

[75] Inventors: Ryu Ito; Akiyoshi Umebara, both of Chiba; Tsuneo Umezawa, Tokyo, all of Japan

[73] Assignee: Lion Corporation, Japan

[21] Appl. No.: 894,307

[22] Filed: Aug. 6, 1986

[51] Int. Cl.[4] ..... A46B 3/16

[52] U.S. Cl. ..... 15/195; 15/205; 15/159 R; 132/163

[58] Field of Search ..... 15/190–205, 15/159 R; 132/85, 84, 163

[56] References Cited

U.S. PATENT DOCUMENTS

| | | | |
|---|---|---|---|
| 2,397,471 | 4/1946 | Cox | 15/191 R X |
| 3,425,084 | 2/1969 | Lavrence et al. | 15/195 |
| 3,574,880 | 4/1971 | Butzen | 15/195 |
| 3,840,932 | 10/1974 | Balamuth et al. | 15/195 |
| 4,475,261 | 10/1984 | Okumura et al. | 15/195 |

*Primary Examiner*—Peter Feldman

*Attorney, Agent, or Firm*—Steinberg & Raskin

[57] ABSTRACT

The invention relates to a brush which comprises a handle portion, a base portion formed with recesses for holding filaments or bristles, an insert which acts as holding means for holding the filaments or bristles in the recesses, and filaments or bristles held in the recesses by the insert. According to the invention, the base portion of the brush, and possible also the handle portion, is formed of a particular plastic which permits the insert which holds the filaments or bristles to press into the sides of the recesses with considerable pressure without cracking the sides so as to permit better holding of the filaments or bristles in the brush base. The plastic forming the base portion should be: a polyamide containing aliphatic, alicyclic and aromatic hydrocarbon units as basic components; a polyamide containing alicyclic and aromatic hydrocarbon units as basic components; a composition consisting of 30–0% by weight of polycarbonate and 70–10% by weight of polyethylene terephthalate; a composition containing 80–100% by weight of polybutylene terephthalate and 20–0% by weight of polyethylene terephthalate; or a composition consisting of 50–100% by weight of polyarylate and 50–0% by weight of polyethylene terephthalate.

6 Claims, 3 Drawing Sheets

BRUSH

BACKGROUND OF THE INVENTION

Brushes such as toothbrushes which are presently on the market are generally formed of a resin such as acrylonitrile-styrene copolymer (hereinafter "AS") or acrylonitrile-butadiene-styrene terpolymer resin (hereinafter "ABS"). The brush filaments which are generally of nylon are set in small holes in the base portion of the brush and are held in these holes or recesses by a thin metal insert which is pressed into the holes.

However, the above mentioned resins which form the base portion of the brush are weak against stress from the outside and strain, and thus tend to become cracked. In addition, these resins are not sufficiently resistant to heat. Consequently, when the toothbrush is disinfected with hot water of 80°–100° C., the filament holding strength of the base portion is decreased with the result that the nylon filaments and the like tend to fall from the holes in which they are inserted.

Attempts have been made to overcome this difficiency by using longer inserts to press more strongly against the sides of the recesses. However, since the brush, and particularly in the case of the toothbrush, is formed of material which is weak against stress and strain, the filament holding recesses or the region between the adjacent filament holding recesses tend to become cracked if the insert is made of a greater length.

Furthermore, if the filament holding recess is made shallower, the brush filament tend to fall more easily from the hole resulting in a low holding strength of the filaments in the base portion of the brush, this being particularly true in the case of the toothbrush.

SUMMARY OF THE INVENTION

It is a primary object of the present invention to provide a brush, the base portion at least of which has high resistance to thermal deformation and cracking and is superior to the conventional brushes in the filament-holding strength in the recesses thereof.

It is another object of the present invention to provide a brush wherein the recesses for holding of the filaments can be made shallower than in the case of brushes of the prior art.

Other objects and advantages of the present invention will be apparent from the further reading of this specification and of the appended claims.

With the above and other objects in view, the present invention mainly comprises a brush having a handle portion, a base portion formed with recesses for holding filaments or bristles, holding means for holding filaments or bristles in the recesses and filaments or bristles held in the recesses by the holding means, the base portion being formed of polyamide containing aliphatic, alicyclic and aromatic hydrocarbon units, or a polyamide containing alicyclic and aromatic units, or a composition consisting of 30–90% by weight of polycarbonate and 70–10% by weight of polyethylene terephthalate, or a composition consisting of 80–100% polybutylene terephthalate and 20–0% by weight of polyethylene terephthalate, or a composition consisting of 50–100% by weight of polyarylate and 50–0% by weight of polyethylene terephthalate.

For convenience, in the following discussion, polycarbonate will be referred to as "PC", polyethylene terephthalate will be referred to as "PET" and polybutylene terephthalate will be referred to as "PBT".

BRIEF DESCRIPTION OF THE DRAWINGS

The invention is more fully described in conjunction with the accompanying drawings, in which.

DESCRIPTION OF PREFERRED EMBODIMENTS

Figure 1:
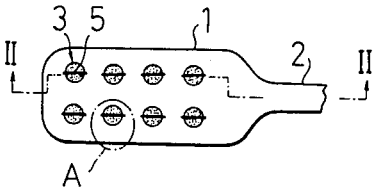
FIG. 1 is a plan view showing the base portion of the brush according to one embodiment of the present invention.
Figure 3:
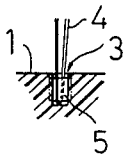
FIG. 3 is a cross sectional view showing in magnified fashion the portion marked "A" in FIG. 1.
Figure 4:
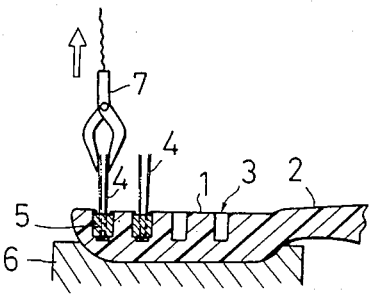
FIG. 4 is a schematic illustration of how the brush filament holding strength is measured.

As is more clearly illustrated by the drawings, and referring to FIG. 1, the brush comprises a base portion 1, a neck portion 2 which extends into a handle portion, recesses 3 for holding brushing filaments 4 shown in FIGS. 3 and 4 and inserts 5 which hold the filaments 4 in the recesses 3.

Figure 2:
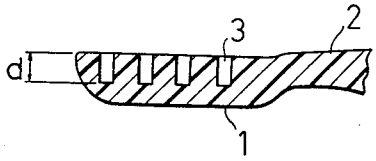
FIG. 2 is a cross sectional view along line II—II of FIG. 1.

The letter d shown in FIG. 2 denotes the depth of the filament holding recess 3. The insert 5 is omitted in FIG. 2.

FIG. 3 which is a cross sectional view enlarged of the portion marked "A" in FIG. 1 shows the brushing filaments 4 held in the recess 3 by the insert 5 in the base portion 1 of the brush.

FIG. 4 which schematically illustrates the measurement of the filament holding strength of the brush shows the base portion 1 of the brush with the neck portion 2 with the filaments 4 held in the recesses 3 by means of inserts 5. The base portion 1 is fixed to a fixing plate 6 and the brush filament 4 as shown is grabbed by a pair of pincers 7 which pulls the filament upward from the base portion 1. The force required for pulling the filament 4 out of the recess 3 is measured by the use of TENSILON UTM-11-20 produced by Baldwin Co., Ltd.

The following examples are given to more fully illustrate the present invention. The scope of the invention is not, however, meant to be limited to the specific details of the examples:

EXAMPLE 1

Base portions of toothbrushes were prepared by injection molding of seven different synthetic resin materials. The resins used were: AS resin; ABS resin; "GRILAMIDE TR-55" (trademark of a polyamide resin produced by Emser Werke, Inc. of Switzerland); a resin composition consisting of 8 parts by weight of PC and 2 parts by weight of PET; a resin composition consisting of 8 parts by weight of PBT and 2 parts by weight of PET; a resin composition consisting of 6 parts by weight of polyarylate and 4 parts by weight of PET; and PBT resin. The polyamide resin, GRILAMIDE TR-55 contains aliphatic, alicyclic and aromatic hydrocarbon units as basic components.

The properties of this polyamide resin were as follows:

| Property | Test Method | Value |
|---|---|---|
| Water Absorption (saturated state) | 20° C. (in water) | 3.3% |
| Water Absorption | ASTM D570 (23° C., 24 Hrs) | 0.33% |
| Light Transmittance | ASTM D1003 | 90% |
| Bending Strength | ASTM D790 | 950 Kg cm/cm$^2$ |
| Impact Strength (notched, 23° C.) | ASTM D256 | 6 Kg cm/cm$^2$ |

The base portions of toothbrushes were prepared from the different resins mentioned above and were shaped shown in FIGS. 1–3. The diameter of the recess 3 in the samples was 1.6 mm. However, the samples made of each resin material included four types classified depending on the depth d of the recess 3, i.e. 3.2 mm and 3.9 mm, and the length of the insert 5 was 1.8 mm and 2.0 mm (the thickness of the insert 5 being 0.25 mm in all samples). A plurality of samples were included for each type of resin. Furthermore, some of the samples of each type were immersed in advance in hot water of 100° C. for 3 minutes.

The brush filament-holding strength of the base 1 was measured by the method illustrated in FIG. 4 as described above. Tables 1 and 2 below show the average values of the results of the measurements. The conditions for preparation of the samples are also shown in the same.

TABLE 1

(Material and Brush filament-holding strength - Part 1)

| Materials of Stock | * | Filament-holding strength (Kg) Depth of hole d 3.9 (mm) | 3.2 (mm) |
|---|---|---|---|
| Prior Art | | | |
| AS | a | 3.4 | 2.9 |
| | b | 0.97 | 0.83 |
| ABS | a | 1.87 | 1.44 |
| | b | 0.75 | 0.58 |
| Present Invention | | | |
| Polyamide resin | a | 1.97 | 1.70 |
| | b | 1.55 | 1.32 |
| PC + PET | a | 1.67 | 1.53 |
| | b | 1.35 | 1.04 |
| PBT + PET | a | 1.86 | 1.86 |
| | b | 1.16 | 1.16 |
| Polyarylate + PET | a | 3.10 | 2.65 |
| | b | 1.60 | 1.48 |
| PBT | a | 1.70 | 1.70 |
| | b | 1.25 | 1.08 |
| Conditions for Sample Preparation | | | |
| Stock Shape | Diameter of hole | | 1.6 mm |
| | Stopper length | | 1.8 mm |
| Sample Heat Treatment | a | Room temp (23° C.) | |
| | b | Hot water, 100° C. × 3 min | |
| Sample No. × Measuring times | 30 × 1, i.e., the above values are average of 30 samples | | |

Note:
*Measuring conditions

TABLE 2

(Material and Brush filament-holding strength - part 2)

| Materials of Stock | * | Filament-holding strength (Kg) Depth of hole d 3.9 (mm) | 3.2 (mm) |
|---|---|---|---|
| Polyamide resin | a | 5.1 | 4.4 |
| | b | 3.3 | 2.8 |

TABLE 2-continued (Material and Brush filament-holding strength - part 2)

| Materials of Stock | * | Filament-holding strength (Kg) Depth of hole d 3.9 (mm) | 3.2 (mm) |
|---|---|---|---|
| PC + PET | a | 3.6 | 3.3 |
| | b | 2.6 | 2.0 |
| PBT + PET | a | 3.2 | 3.2 |
| | b | 2.1 | 2.1 |
| Polyarylate + PET | a | 6.2 | 5.3 |
| | b | 2.6 | 2.4 |
| PBT | a | 3.1 | 3.1 |
| | b | 2.2 | 1.9 |
| Condition for Sample Preparation | | | |
| Stock Shape | Diameter of hole | | 1.6 mm |
| | Stopper length | | 2.0 mm |
| Sample Heat Treatment | a | Room temp (23° C.) | |
| | b | Hot water, 100° C. × 3 min | |
| Sample No. × Measuring times | 30 × 1, i.e., the above values are average of 30 samples | | |

Note:
*Measuring conditions

EXAMPLE 2

Tooth brush samples of the shape shown in FIGS. 1–3 were prepared using the synthetic resin materials of example 1. The recesses for holding the filaments of the samples was 1.6 mm in diameter in each sample.

An insert 1.8 mm long and 0.23 mm thick, or 2.0 mm long and 0.25 mm thick was inserted into the recess 3 of each brush base with a constant impact strength. After the striking of the insert, crack occurrence around recess 3 was examined with the results as shown in Table 3. The average value of 50 measurements is given in Table 3.

TABLE 3

(Insert length and Crack occurrence)

| Insert Length (mm) | Crack occurrence about recess (%) AS | ABS | Polyamide resin | PC + PET | PBT + PET | Polyarylate + PET | PBT |
|---|---|---|---|---|---|---|---|
| 1.8 | 11 | 0 | 0 | 0 | 0 | 0 | 0 |
| 2.0 | 100 | 79 | 0 | 0 | 0 | 0 | 0 |

The following conclusions can be obtained from Tables 1–3.

(1) Table 1 confirms that the heat resistance of the conventional resin materials AS and ABS is so low that the filament-holding strength of the toothbrush made of this resin material is markedly lowered by heat treatment for 3 minutes with hot water of 100° C. Particularly in the case where the depth of the recess 3 is 3.2 mm, the filament-holding strength is so low that it is substantially impossible to put such toothbrush to practical use.

(2) Table 1 also shows that the brush filament-holding strength of the insert is lowered only slightly by the same heat treatment when the toothbrush is made in accordance with the present invention. Of course, the toothbrush of the present invention can therefore be put to practical use in a satisfactory manner.

(3) Tables 1 and 2 show that the insert of the toothbrush of the present invention has a sufficiently high brush filaments-holding strength whether the brush filament recess is 3.9 mm deep as in the conventional toothbrush, or even in the case where it is as shallow as 3.3 mm. It should be noted that the brush filament recess is generally 3.9–4.0 mm deep in conventional tooth brushes.

(4) Table 3 still further shows that in the case of the conventional toothbrush made of AS resin or ABS resin, it is substantially impossible to insert an insert having a length of 2.0 mm into a brush filament recess having a diameter of 1.6 mm. If the insert is struck into the recess, cracks occur about the recess or in a region between the recesses, making the toothbrush substantially unsaleable.

(5) Tables 2 and 3 show that it is possible to have an equal filament-holding strength to that of the conventional toothbrush in accordance with the present invention when the recess for the holding of the filament is made shallower in the base than in the conventional toothbrush. Therefore it follows that it is possible according to the present invention to utilize an insert which is longer than that utilized in the conventional toothbrush with the result that the present invention permits marked improvement in the filament-holding strength.

EXAMPLE 3

Tooth brushes were prepared in which the insert portions were formed by injection molding of a resin mixture consisting of PC (polycarbonate) and PET (polyethylene terephthalate). The tests covered cases where the PC content of the resin mixture was 5%, 10%, 20%, 30%, 40%, 50% 60% and 70% by weight, as well as the case of 100% PC resin and 100% PET resin. In each case the insert was made 1.6 mm in diameter and 3.2 mm in depth. 100 samples were prepared for each case. Inserts 1.8 mm long were inserted into the recesses in 50 samples, with inserts 2.0 mm long being inserted into the recesses in the remaining 50 samples in each case. In addition, the entire toothbrush was immersed in hot water of 100° C. for 3 minutes with respect to one half of the samples for each case.

The brush filament-holding strength was measured as in Example 1 for all of the prepared examples. In addition, deformation in the handle portion of the toothbrush was observed in the step of immersing the sample in the boiling water.

Figure 5:
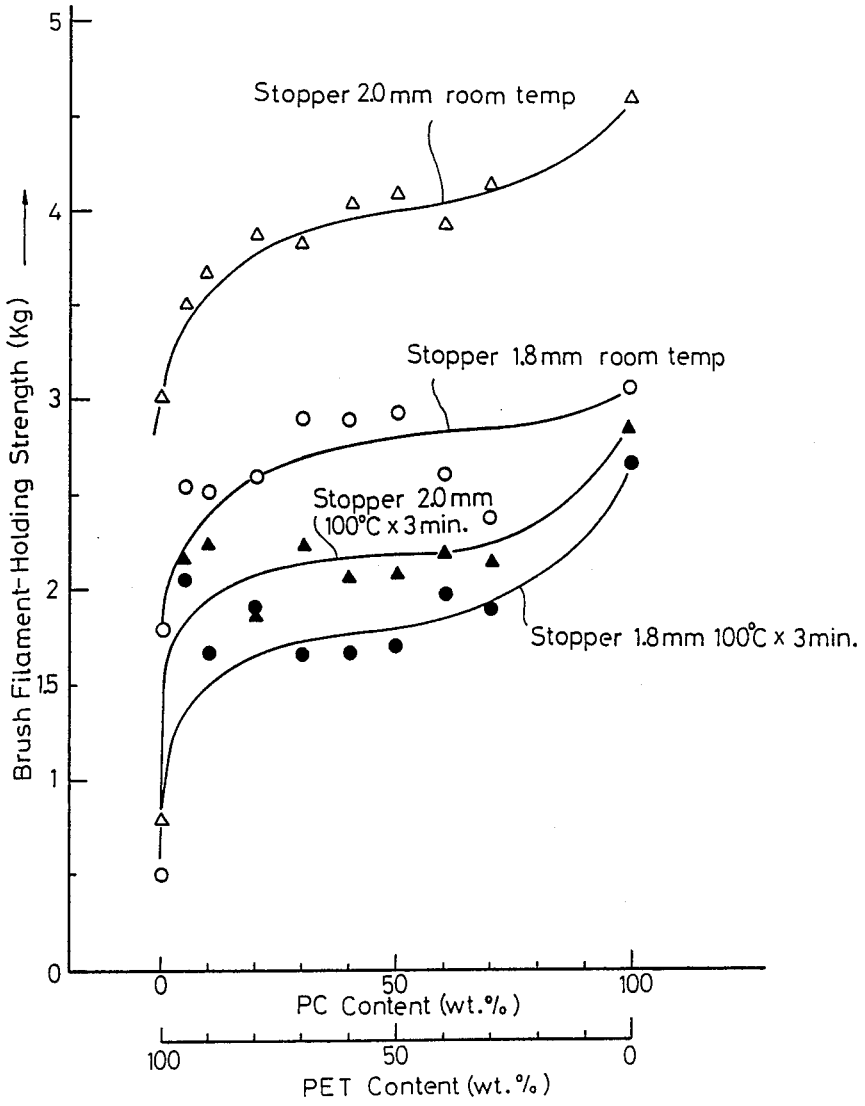
FIGS. 5 and 6 are graphical representations showing the brush filament holding strength of brushes according to the different embodiments of the present invention.

FIG. 5 shows the average values of the brush filament-holding strength resulting from these tests. It is seen that in the case where the PC content of the resin mixture is 5% or more, it is substantially possible to prevent the brush filaments falling out of the recesses even if the toothbrush is immersed in boiling water. However, the toothbrush is somewhat deformed thermally if the PC content is 20% or less. Thus, it is desirable in accordance with the present invention that the PC content be 30% or more. On the other hand, the PC content of the resin mixture should not exceed 90% by weight. If the PC content is higher than 90% by weight, cracks tend to occur around the recesses in the actual use of the toothbrush in which a tooth paste or tooth powder is in contact with the base portion of the toothbrush. It is for this reason that in accordance with the present invention the PC content of the resin mixture is preferred to be between 30% and 90% by weight.

EXAMPLE 4

Toothbrushes sized as an Example 3 were prepared in which the base portion was formed by injection molding of a resin mixture consisting of PBT and PET. The brush filaments were inserted and the samples were immersed in boiling water as in Example 3. However, in this example, the compositions were prepared wherein the PBT content of the resin mixture was 10%, 20%, 30%, 40%, 50%, 60%, 70%, 80% and 90% by weight as well as the case of 100% PBT and 100% PET.

Figure 6:
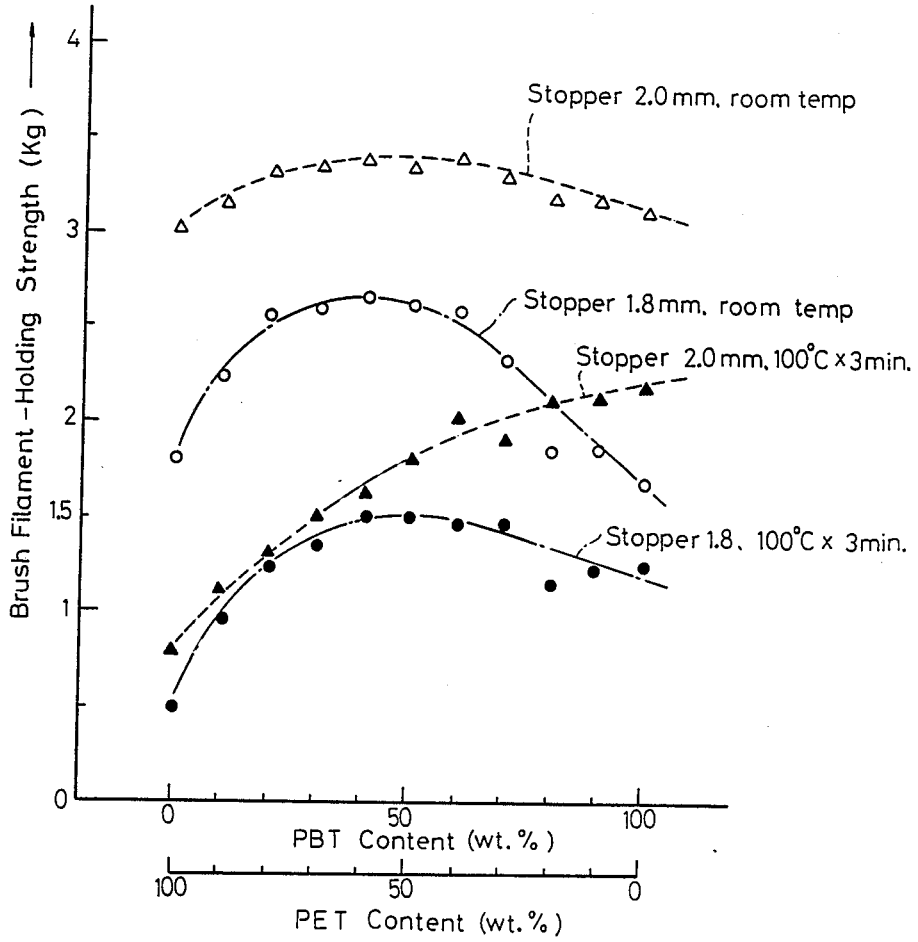

The brush-filament-holding strength was measured for all samples thus prepared in the same manner as in Example 1, the results being set forth in FIG. 6. As may be seen from FIG. 6, the brush filament-holding strength is sufficiently high where the PBT content of the resin mixture is 60% by weight or more. In this case, the high filament-holding strength is maintained even if the toothbrush is immersed in boiling water. However, the toothbrush is thermally deformed if the PBT content is 70% or less. Consequently, it is preferred that the resin mixture contain 80% or more of PBT in order that the toothbrush can exhibit a high filament-holding strength and in addition a high resistance to thermal deformation.

EXAMPLE 5

Toothbrushes were prepared in which the base portion was formed by injection molding of a resin mixture consisting of PET and polyarylate. The experiment covered cases where the PET content of the mixture was 40%, 50%, 60% and 70% by weight, as well as the cases of 100% PET and 100% polyarylate. The brush filaments were inserted as in Example 3, except that the insert used in this experiment was 1.8 mm in length. Further, heat treatment was applied to the toothbrush samples thus prepared by immersing the sample for 3 minutes in hot water of 80° C., 90° C. and 100° C.

The brush filament-holding strength of the samples were measured as in Example 1. In addition, the thermal deformation of the handle portion of the toothbrush sample was observed after the heat treatment. The results are set forth in Table 4 which follows.

TABLE 4

(Properties of Polyarylate + PET type Tooth Brush)

| Polyarylate | Hair-Holding Strength (Kg) | | | Thermal Deformation (mm) | | |
|---|---|---|---|---|---|---|
| (%) | 80° C. | 90° C. | 100° C. | 80° C. | 90° C. | 100° C. |
| 100 | 3.54 (O) | 3.41 (O) | 3.42 (O) | 0.04 (O) | 0.04 (O) | 0.03 (O) |
| 60 | 2.00 (O) | 1.86 (O) | 1.60 (O) | 0.06 (O) | 0.06 (O) | 0.09 (O) |
| 50 | 1.82 (O) | 1.54 (O) | 1.20 (Δ) | 0.08 (O) | 0.11 (Δ) | 0.18 (Δ) |
| 40 | 1.70 (O) | 1.33 (Δ) | 0.98 (X) | 0.09 (O) | 0.16 (Δ) | 0.67 (X) |
| 30 | 1.2 (Δ) | 0.9 (X) | 0.6 (X) | 0.17 (Δ) | 0.32 (X) | 0.65 (X) |
| 0 | 0.70 (X) | — | — | 0.70 (X) | — | — |

Note:
Brush filament-holding strength:
(O) 1.5 Kg or more; very good
(Δ) 1.0 to less than 1.5 Kg; good
(X) less than 1.0 Kg; poor
Thermal deformation:
(O) less than 1.0 mm; negligible
(Δ) 0.10 mm to less than 0.20 mm; slight deformation, but usable
(X) 0.20 mm or more; highly noticeable deformation In the case of the resin mixture consisting of PET and polyarylate, both the filament-holding strength and the resistance to thermal deformation is markedly improved in the case where the polyarylate content of the resin mixture is 50% by weight or more, including the case of 100% polyarylate resin, as is clear from Table 4.

In the brush of the present invention, the brush filament recess should desirable be between 2.8–3.6 mm in depth, most preferrably 3.2–3.4 mm in depth.

The present invention is not meant to be limited to toothbrushes. The scope of the invention is clearly applicable to the case of all types of brushes such as hair brushes, and industrial brushes in which the brush filaments are held in the filament recesses by the use of inserts.

As described in detail, the brush of the present invention makes it possible to utilize recesses for holding of the filaments which are markedly less deep than in the case of the prior art. The reduction in depth of the recess permits the base portion to be made thinner. Thus, in the case of toothbrushes, the brush portion can easily be moved within the mouth to reach the deepest portions of the mouth, much more easily than in the case of prior art toothbrushes containing thicker base portions. Thus, the use of the brush can provide an improved cleaning effect. Still further, the amount of resin used is decreased because of the reduction in thickness of the base portion, leading to a further reduction in manufacturing costs of the brush.

It should also be noted that in the case where the depth of the brush filament-holding recess is made equal to the conventional toothbrushes, the present invention makes it possible to increase the length of the insert, leading to a marked improvement in the brush filament-holding strength of the base portion. As a result, the brush filaments do not fall out of the recesses even if the brush is immersed in hot water of 80°–100° C. for the purpose of disinfection.

It is apparent that while the invention has been described with respect to specific details and compositions, variations and modifications of the invention can be made, and such variations and modifications are meant to be comprehended within the meaning and scope of the present invention.

What is claimed is:

1. A brush, comprising a handle portion, a base portion formed with recesses for holding filaments or bristles, holding means for holding filaments or bristles in said recesses, and filaments or bristles held in said recesses by said holding means, said base portions being formed of a synthetic resin which permits said holding means to be pressed into the sides of the recesses without cracking or deformation of the base portion, wherein said base portion is formed of a composition consisting of 30–90% by weight of polycarbonate and 70–10% by weight of polyethylene terephthalate.

2. A brush, comprising a handle portion, a base portion formed with recesses for holding filaments or bristles, holding means for holding filaments or bristles in said recesses, and filaments or bristles held in said recesses by said holding means, said base portions being formed of a synthetic resin which permits said holding means to be pressed into the sides of the recesses without cracking or deformation of the base portion, wherein said base portion is formed of a composition consisting of 80–100% by weight of polybutylene terephthalate and 20–0% by weight of polyethylene terephthalate.

3. A brush, comprising a handle portion, a base portion formed with recesses for holding filaments or bristles, holding means for holding filaments or bristles in said recesses, and filaments or bristles held in said recesses by said holding means, said base portions being formed of a synthetic resin which permits said holding means to be pressed into the sides of the recesses without cracking or deformation of the base portion, wherein said base portion is formed of a composition consisting of 50–100% by weight of polyarylate and 50–0% by weight of polyethylene terephthalate.

4. Brush according to claim 1 wherein the recess is 2.8 to 3.6 mm deep.

5. Brush according to claim 2 wherein the recess is 2.8 to 3.6 mm deep.

6. Brush according to claim 3 wherein the recess is 2.8 to 3.6 mm deep.

* * * * *